United States Patent [19]

Sullivan

[11] 4,075,719

[45] Feb. 28, 1978

[54] CHAIR LIFT APPARATUS

[76] Inventor: Lawrence J. Sullivan, 2688 E. 25th St., Odessa, Tex. 79761

[21] Appl. No.: 719,619

[22] Filed: Sep. 1, 1976

[51] Int. Cl.[2] ..... A47B 83/04; A47K 3/12

[52] U.S. Cl. ..... 5/81 R; 4/185 L; 5/92; 214/75 R; 254/93 R

[58] Field of Search ..... 108/139, 143, 144, 147; 4/185 L; 254/93 R, 184; 214/75 R, 730; 232/35; 297/347; 5/81, 83, 86, 92

[56] References Cited

U.S. PATENT DOCUMENTS

| | | | |
|---|---|---|---|
| 677,967 | 7/1901 | Fenstermacher | 232/35 |
| 2,148,932 | 2/1939 | Fisher | 214/75 R |
| 2,792,951 | 5/1957 | White | 5/83 |
| 3,220,575 | 11/1965 | Batty et al. | 5/81 R |
| 3,270,353 | 9/1966 | Berthelsen et al. | 5/81 R |
| 3,815,163 | 7/1974 | Sullivan | 4/185 L |
| 3,829,916 | 8/1974 | James | 5/81 R |

*Primary Examiner*—Casmir A. Nunberg
*Attorney, Agent, or Firm*—Marcus L. Bates

[57] ABSTRACT

Lift apparatus by which wheelchair invalids are lifted from one location, through a spiral, to another location. The lift apparatus includes coacting movable and fixed support members which are telescopingly received within one another to form a variable chamber therebetween.

A cantilever arm is affixed to and radially extends from the movable support member. A pair of spaced arms are affixed to the cantilever arm and removably engage a chair. The cantilever arm is adjustably affixed to the movable support member such that the arm can be adjustably positioned along any radial extending from the axial centerline of the support members.

A cam means is jointly associated with the two support members in such a manner that when fluid pressure telescopes the two support members apart, the cantilever arm is rotated 45° towards the end of the upstroke and thereafter, the cantilever arm is rotated another 45° as the chair is lowered back into proximity of the original elevation.

14 Claims, 10 Drawing Figures

FIG. 1
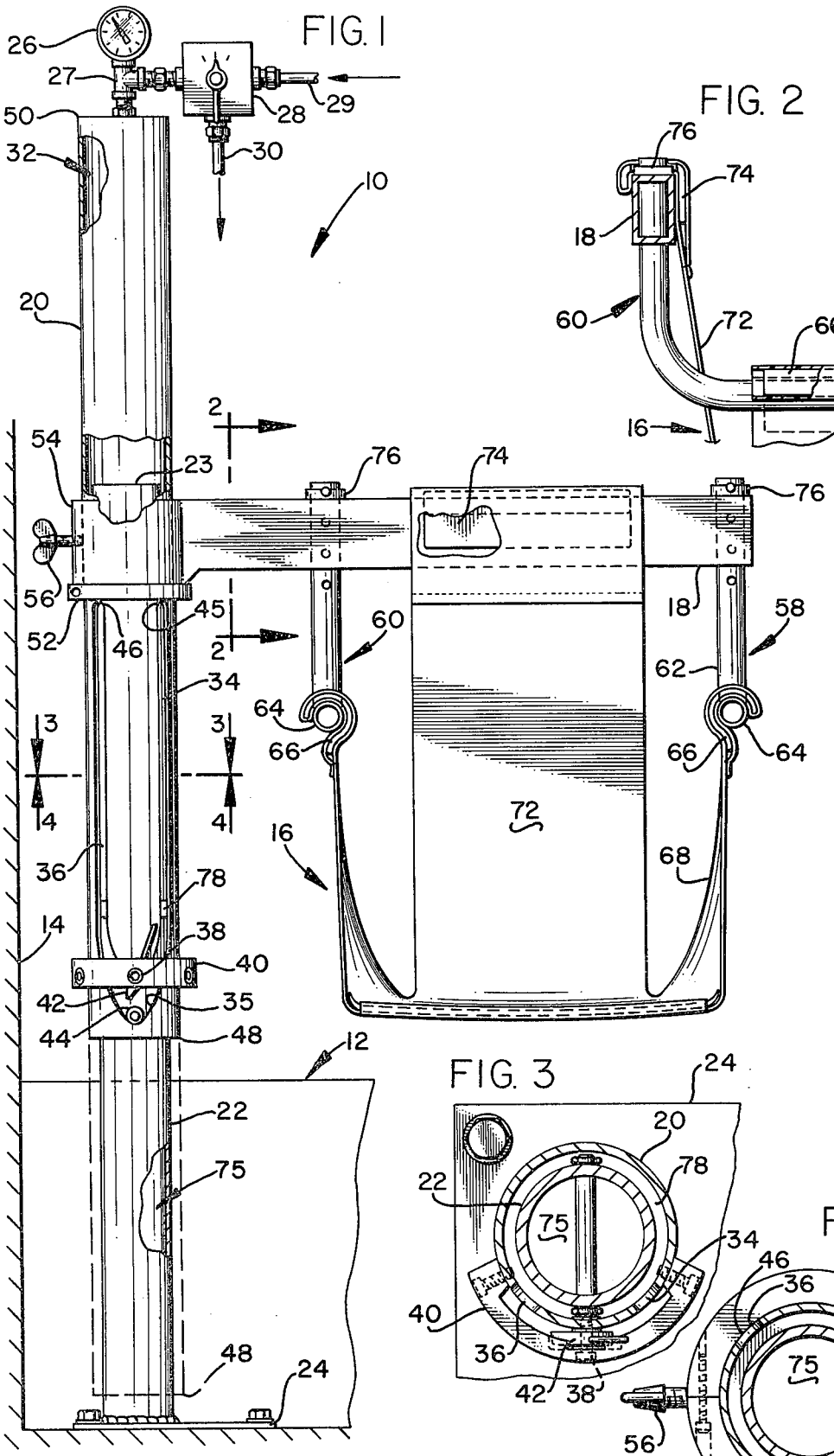
FIG. 2
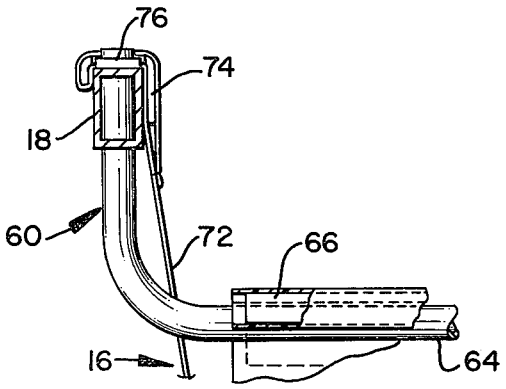
FIG. 3
FIG. 4
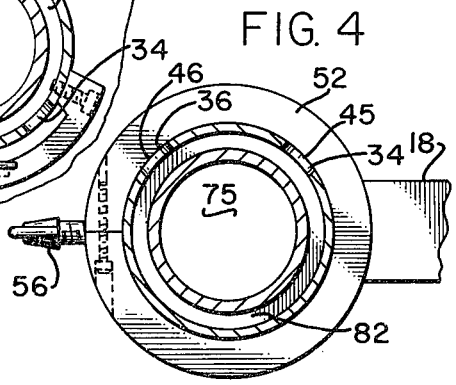

CHAIR LIFT APPARATUS

PRIOR ART

Sullivan, U.S. Pat. No. 3,815,163, discloses a chair lift device by which an invalid can be lifted into and out of a bathtub. This patent, along with the art cited therein, requires that the invalid somehow be manipulated into and out of the chair lift device.

BACKGROUND OF THE INVENTION

Wheelchair invalids often are robust people who have lost the use of their lower extremities, and therefore they maintain a faculty for the use of the remaining portions of their anatomy. Most wheelchair invalids do not require assistance for propelling themselves from one location to another; however, it is extremely difficult for the average invalid to transfer himself from a wheelchair into a bathtub and vice versa, especially if the invalid is overweight.

There are many invalids who are capable of safely driving vehicles; however, they cannot transfer themselves from a wheelchair into the vehicle. Many invalids can move about in a vehicle once they have been placed within the interior thereof.

Accordingly, it is desirable to have made available apparatus by which an invalid can transfer himself from a wheelchair into a bathtub and vice versa. It is furthermore desirable that the same apparatus have the capability of transporting the invalid, along with his wheelchair, into and out of a van-type vehicle.

It would be desirable that the invalid be able to accomplish the foregoing unassisted by other people, thereby returning independence to the invalid and giving him more confidence and mobility than heretofore was possible.

SUMMARY OF THE INVENTION

This invention comprehends lift apparatus by which wheelchair invalids are rotatably lifted through a spiral. The lift apparatus includes a stationary, vertical support member which is telescopingly received by a movable vertical support member, with the two members cooperating together to form a variable chamber. Fluid can be forced into and out of the variable chamber to cause the two coacting support members to be extended and retracted relative to one another.

A cantilever arm is radially attached to the movable support member in such a manner that the arm can be adjusted vertically and pivotally respective thereto. The free marginal end of the cantilever arm is provided with spaced, laterally arranged, arm engaging members which provide a plurality of desirable functions. The arms engage a seat in a removable manner so that a patient can be seated therein and lifted from a wheelchair into a bathtub and vice versa. The arms further removably receive a leg support which is forwardly directed in spaced relationship to the seat so that the legs of a patient can be supported horizontally, thereby facilitating transfer of the patient into and out of the bathtub. The arm engaging members furthermore provide a lift means by which the arms of a wheelchair can be engaged in a manner to lift the wheelchair along with its occupant in a spiral manner so that he is transported vertically upward and pivotally into a van-type vehicle.

Cam means are jointly connected to the two support members for causing relative axial rotation therebetween in response to vertical movement of the movable support member.

Accordingly, a primary object of the present invention is the provision of a lift apparatus for releasably engaging and spirally transporting a chair from one to another location.

Another object of the present invention is the provision of a lift apparatus for lifting invalids into and out of wheelchairs.

Another object of the invention is to provide lift apparatus for lifting invalids from a wheelchair into a bathtub, and vice versa.

A further object of this invention is to disclose and provide a lift apparatus for lifting invalids along with a wheelchair into and out of vehicles.

A still further object of this invention is the provision of a lift apparatus for lifting a person confined to a wheelchair into and out of a vehicle.

Another and still further object of the present invention is to provide a lift apparatus by which wheelchair invalids are lifted through a 90° spiral.

An additional object of this invention is to disclose and provide a lift apparatus by which a person can lift himself in a spiral manner from one location to another.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

BRIEF DESCRIPTION OF THE DRAWINGS

FIG. 1 is a part cross-sectional, side elevational view of lift apparatus made in accordance with the present invention;

FIG. 2 is a fragmented, cross-sectional detail taken along line 2—2 of FIG. 1, which discloses some additional details of the apparatus disclosed in FIG. 1;

FIG. 3 is a fragmented, part cross-sectional view taken along line 3—3 of FIG. 1;

FIG. 4 is a fragmented, part cross-sectional view taken along line 4—4 of FIG. 1;

DETAILED DESCRIPTION OF THE PREFERRED EMBODIMENT

Figure 5:
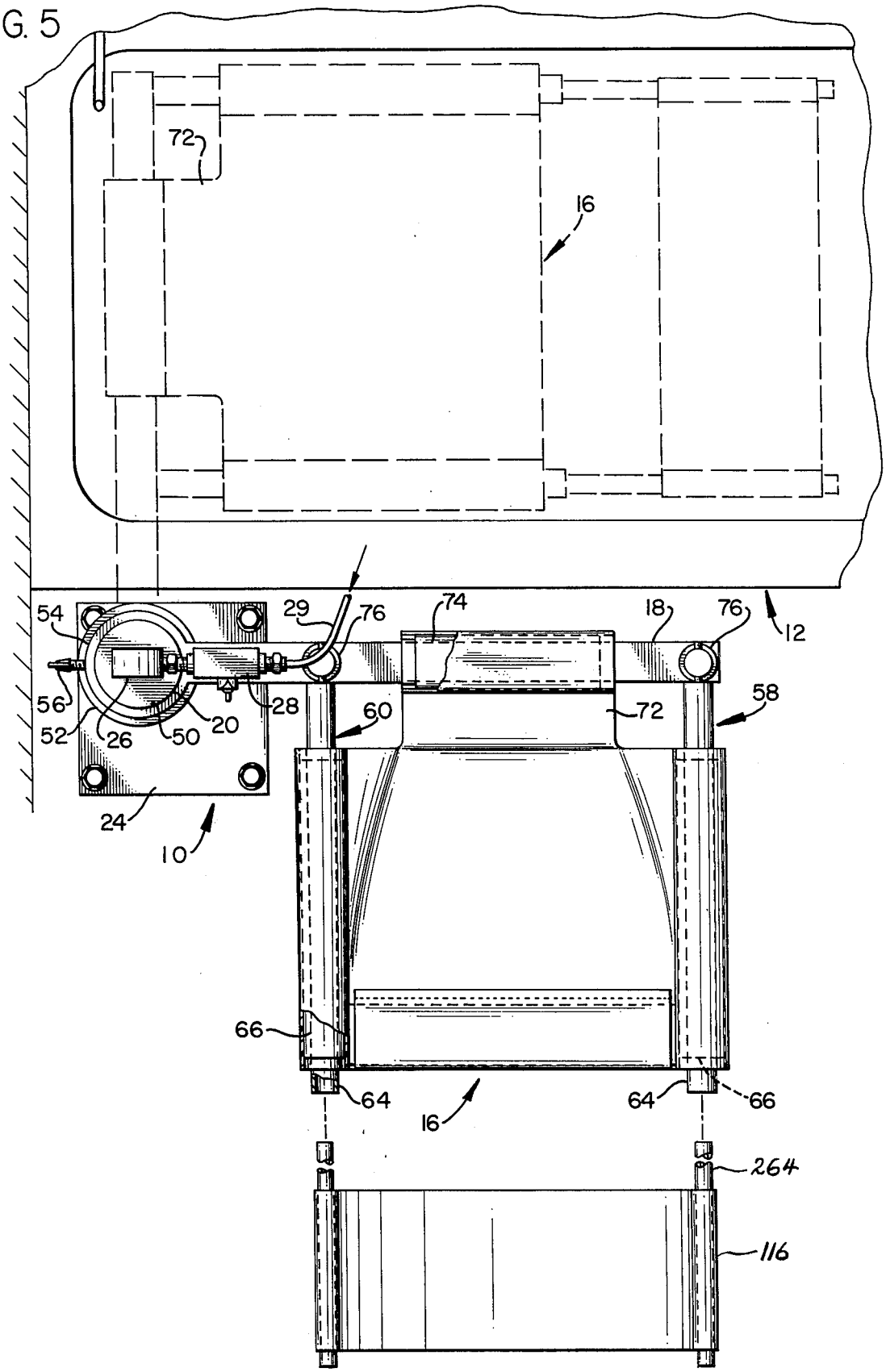
FIG. 5 is a top plan view of the apparatus seen disclosed in FIG. 1.

In the figures of the drawings, a lift apparatus is broadly indicated by the arrow at numeral 10. The lift apparatus enables invalids to be pivotally lifted from one location to another; as for example, through a spiral of about 90°. This expedient enables an invalid to be conveniently lifted into and out of a bathtub 12 without employing assistance from others. The tub usually is positioned in a corner of a room adjacent to a wall 14.

As seen in the illustration of FIGS. 1, 2, and 3, a chair apparatus 16 is removably supported by a cantilever arm 18, which in turn is adjustably affixed in a rotatable and slidable manner to an upper cylindrical member 20, hereinafter referred to as the movable member.

A lower cylindrical member 22 reciprocatingly receives the movable member and includes an upper end 23 opposed to a support base 24. Member 22 will hereinafter be referred to as the fixed or stationary member. The support base can be placed at any quadrant of the tub and will operate to the left or right as may be required.

Weight indicator 26, in the form of a pressure gauge, is connected to a pipe fitting 27, which in turn is connected to the illustrated three-way valve means 28. The valve is connected to a source of fluid 29 and to a discharge 30. A variable chamber 32 is formed between the movable and fixed members, and is flow connected to the valve.

A cam means is jointly formed by the fixed and movable members for causing relative axial rotation therebetween when the members are reciprocated respective to one another. The cam means includes two radially spaced slots cut into the movable member to form a first leg 34 which commences at a medial portion of the movable member and extends towards the lower end thereof where the slot bends 180° at 35 to form a second leg 36. The second leg is parallel and coextensive with the first leg. The elongated camway cuts a tab into the movable member.

A pivot pin 38 is connected to a bridge 40 for supporting a flip-flop, over-the-center cam guide member 42, hereinafter called a switch means. The bridge reinforces the tab formed in the movable member by securing the free end of the elongated island of material to spaced locations thereon.

Figure 6:
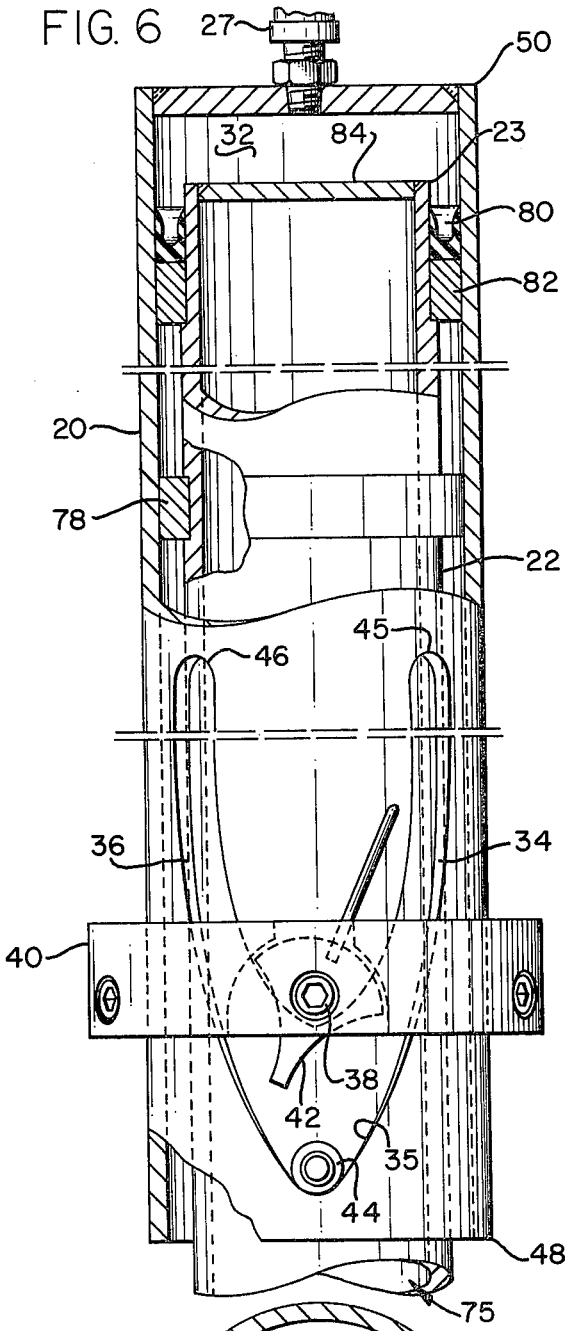
FIG. 6 is an enlarged, fragmented, part cross-sectional illustration which sets forth additional details of the apparatus disclosed in the foregoing figures.
Figure 7:
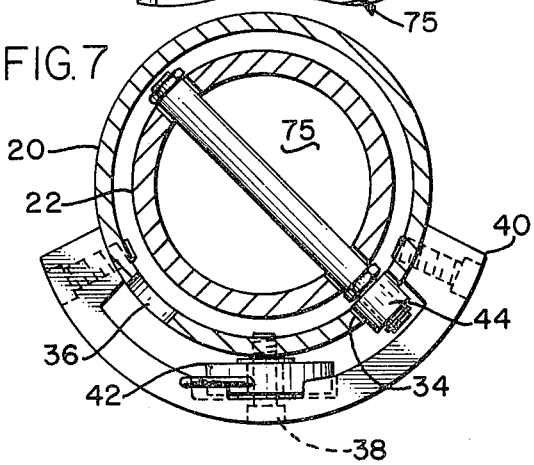
FIG. 7 is a horizontal cross-sectional view of the apparatus disclosed in FIG. 6.

A cam follower in the form of a roller 44 is journaled to the fixed member in the illustrated manner of FIGS. 3, 6, and 7. The roller is received in slidable, captured relationship within the illustrated slot where it can move from one end 45, through the entire slot, and back to the remaining end 46 thereof.

The inside and outside walls of the cam slot are formed along different centers so that the cam follower can clear the cam switch on the upstroke. The cam follower engages the cam switch on the downstroke and follows the inside contour of the cam slot. On the upstroke, the cam follower follows the outside contour of the cam slot so as to clear the cam switch.

Numerals 48 and 50 indicate the lower and upper terminal ends of the movable member. A collar 52 circumferentially extends about the exterior of the movable member and provides an adjustable support means for supportingly receiving cylindrical boss 54 of the cantilever arm in abutting relationship thereto so that the collar bottom supports the cantilever arm. The boss 54 is slidably received along the exterior surface of the movable member and is provided with a lock means in the form of a screw 56. A plastic bearing can be interposed between the boss, collar, and movable member to further reduce the friction therebetween, if desired.

Two spaced chair arm engaging assemblies 58 and 60 are secured to the free outer marginal end of the cantilever arm and include axially rotatable vertical members 62 which are bent laterally away from the cantilever arm at 64. The chair 16 includes an arm in the form of a removable plastic or metal reinforcement 66 which removably engages lateral member 64. The seat 68 of the chair includes sides which are affixed to member 66, with the back 72 of the seat being affixed to a U-shaped plastic or metal reinforcement 74. The U-shaped attachment of the seat back is removably supported from the cantilever arm in the illustrated manner of FIG. 2.

Hency any load placed on the chair or sling seat 16 pulls the reinforcements into locked position respective to their complementary support members.

As seen in FIGS. 1, 3, and 4, the lower, fixed member is hollow at 75. The cam follower is in the form of a roller which is journaled to an extended end portion of the illustrated bolt. The bolts extends through and preferably is threaded to the rear sidewall of the fixed member 22 such that the roller is received between the immediate wall surfaces formed by the slot.

As seen illustrated in FIGS. 1 and 5, together with FIG. 2, the chair arm engaging assemblies are received through apertures formed in the hollow cantilever arm, so that the assemblies are rotatable about a vertical axis and received within a bushing 76. The bushings contain a detent in the upper end thereof within which the illustrated pin is fitted so that the chair engaging assemblies are urged into the illustrated lateral position. The chair arm engaging assemblies can be rotated 180° when it is necessary to use the chair lift device in conjunction with a bathtub which may be located opposite from the illustration seen in FIG. 1.

As seen in FIGS. 6 and 7, in conjunction with FIGS. 1 and 3–5, the expansible chamber 32 is formed by the before mentioned coacting fixed and movable members. Teflon bushings 78 and 82 are secured to the fixed member for aligning the two coacting members along their common axial centerline. Seal 80 sealingly engages the annulus formed between the two telescoping members and abuttingly engages the bushing 82. The bushings and seal are each affixed to the fixed member. The upper terminal end of the fixed member is closed by a bulkhead, as indicated by numeral 84. Fastener means 38 serves the dual purpose of providing a pivot for the switch 42, while at the same time, the tab resulting from the formation of the cam groove is rigidly affixed to the bridge 40. The bridge 40 circumferentially extends about the exterior of the movable member an amount to enable the marginal ends of the bridge to be tied to structure located at spaced areas outwardly from the grooves 34 and 36.

The switch has a center of gravity located above the pivot point 38 so that it operates with an over-the-center action, and remains in one of its alternate positions, as seen illustrated in FIGS. 6 and 7. The switch is reset to its alternate position by the cam follower each stroke of the support members.

Figure 8:
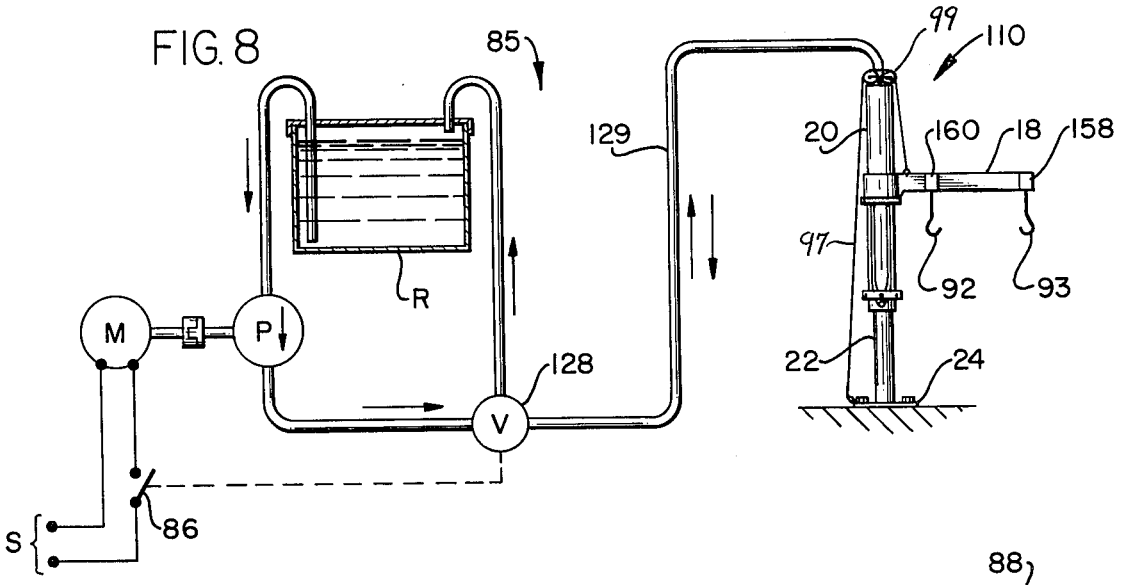
FIG. 8 is a schematical representation of a hydraulic flow system for use in conjunction with a lift device of the present invention.

In FIG. 8, the numeral 85 broadly indicates a hydraulic system for use in conjunction with a chair lift of the present invention. Electrical switch 86 is actuated in response to movement of a control valve 128 into a position which causes fluid flow from the reservoir, through the illustrated pump, through the valve, along conduit 129, and into the movable member of the lift apparatus 110.

Figure 9:
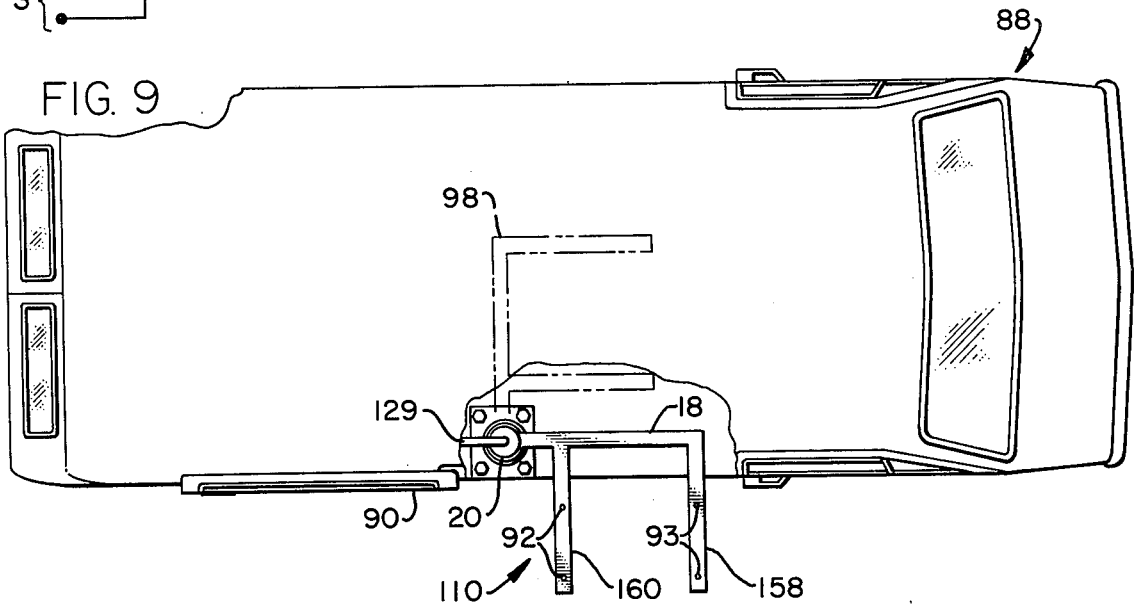
FIG. 9 is a broken, top plan view which discloses one operative configuration of the apparatus disclosed in FIG. 8; and, FIG. 10 is a side elevational view of the apparatus disclosed in FIG. 9.
Figure 10:
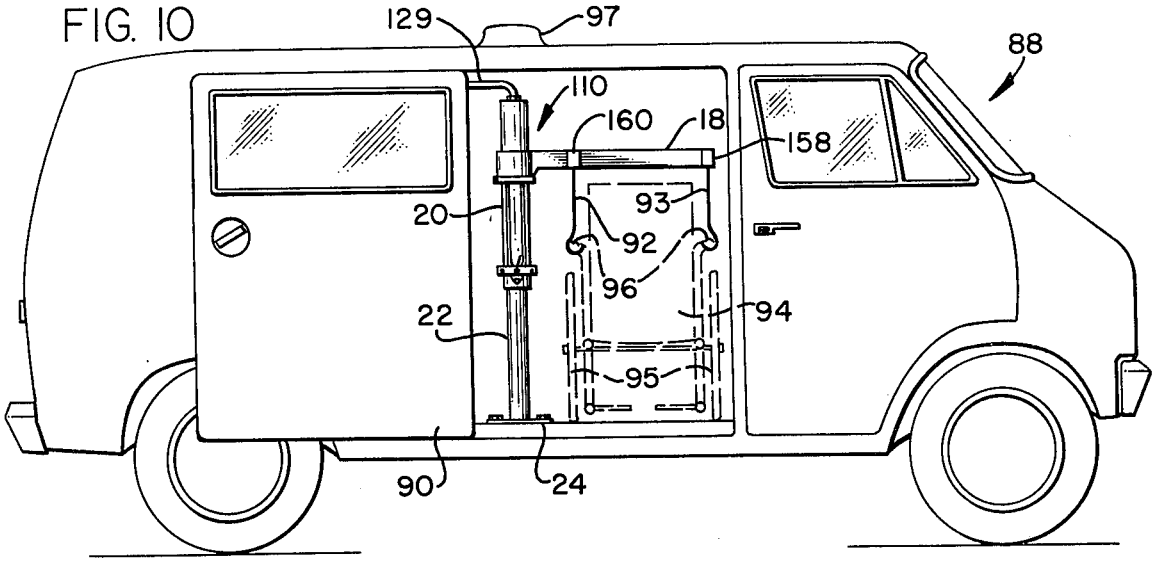

As seen in FIG. 10, lateral arms 158 and 160 each contain a pair of chair engaging means, 92 and 93, which enable the apparatus to be lowered into engagement with a chair 94. The chair includes the usual wheels 95 and armrest 96. The arms of the wheelchair are engaged by the hook members 92 and 93 so that the cantilever arm can left the chair in a spiraling direction, whereupon the chair is transported through door 90 of vehicle 88 and into the illustrated position seen at 98 in FIG. 9.

An invalid seated in the chair can lift himself into a van-type automobile, and thereafter lift himself out of the wheelchair by utilizing his hands to engage overhead structure and thereby manipulate his body into the driver's seat.

When the invalid is ready to alight from the vehicle, he reverses the above procedure and seats himself within the chair 94. The lift apparatus is then energized to cause the cantilever arm to move the wheelchair in an upward and then downward spiraling direction so that the wheelchair is moved from the illustrated dot-dash position 98 into the unloading position of FIG. 9.

In operation of the embodiment of the invention disclosed in FIGS. 1–7, the valve 28 can be positioned as shown in FIG. 1, or alternatively, positioned in proximity of either of the arm engaging assemblies 58 or 60. Valve 28 preferably is connected to a domestic water supply. The valve, when moved to one of its alternate positions, causes flow to occur from the source of pressure 29 into the variable chamber 32. This action causes the movable member to be lifted into the illustrated position of FIG. 1. This movement is effected by fluid filling the expansible chamber 32 and forcing the telescoping members apart so that the cam follower 44 moves from proximity of end 46, down the slot 36, to the lowermost position of the camway seen at 35 in FIG. 1. Valve 28 is next moved to its alternate position, allowing discharge of fluid from chamber 32 and through the outlet 30. This action lowers the movable member respective to the fixed member, whereupon roller 44 engages the switch 42, causing member 20 to rotate clockwise as the roller 44 travels up the slot 34 towards end 45.

As roller 44 engages and passes over switch 42, the switch is moved to its alternate, over-the-center position of FIG. 3 so that when the telescoping members are cycled again, the roller will move down with groove 34, into the illustrated position of FIG. 1, whereupon, downward movement of member 20 will cause the roller to engage the switch and be guided into the opposed parallel leg 36 of the groove. At the same time, the cam follower will reset the switch so that during the next cycle of operation the roller is positioned in the opposed groove.

The chair apparatus 16 preferably is placed within the wheelchair and thereafter the invalid seated thereon so that the invalid can propel himself into proximity of the lift apparatus. At this time, the lift apparatus will be in the configuration of FIG. 5. The patient engages members 66 of the chair with the lateral arms 64 and places member 74 about the cantilever arm 18. The patient next manipulates the valve 28 to cause himself to be lifted upward and then downward in a spiral manner, so that he becomes seated in the bathtub as indicated by the dot-dash lines at numerals 16 and 72 in FIG. 5. After the patient has bathed himself, he reverses the above procedure so that he again becomes seated in his wheelchair. The chair apparatus is disengaged from the lift apparatus and the patient returns to his room unassisted by others.

In extreme cases, it is advantageous to support the patient's legs with the apparatus 116 seen illustrated in FIG. 5. The leg support apparatus includes spaced tubular members 264 having marginal end portions of members 64 so that the patient's legs are conveniently supported as he is transported over the rim of the tub.

In operation of the apparatus disclosed in FIGS. 8–10, the valve 128 is mechanically connected to close switch 86 when the valve is moved into the lift position. Accordingly, in the closed hydraulic circuitry of FIG. 8, the apparatus is illustrated in the standby configuration. Valve 128 is moved to one of its alternate positions to energize switch 86, whereupon the illustrated motor causes the hydraulic pump to force fluid from the reservoir, through the valve, along conduit 129, and into the variable chamber of the movable member, thereby causing the movable member to extend in an upward direction.

Valve 128 is thereafter moved to its remaining alternate position, causing fluid to be forced from the variable chamber, back through tubing 129, through the valve, and into the reservoir as the movable member gravitates back to its lowermost position.

The wheelchair patient moves his chair into an aligned position respective to the lift device of FIG. 9. The hooks 92 and 93 engage the chair arms 96, valve 128 is moved to energize the pump and to force hydraulic fluid into the expansible chamber of the lift device, whereupon the chair is lifted as the upper member reciprocates to its upper limit. The valve is turned to its alternate position to cause the wheelchair to be rotatably lowered into the van 88 as illustrated in FIG. 10.

The invalid next grasps overhead structure with his hands and manipulates himself into the driver's seat.

The invalid reverses the above procedure when he is ready to alight from the vehicle.

The control valve 28 can be throttled to enable the rate of movement of the chair to be controlled. The chair can be positioned at any intermediate position by closing the valve. After a patient has washed, he can raise himself out of the water, stop the chair in a position vertically suspended above the bath tub, dry himself with a towel, and thereafter complete the cycle of operation by again opening the valve so that the chair 16 is moved out of the tub and repositioned within a wheelchair.

Where deemed desirable, a cable 97 can be affixed to the base 24 and rove about pulley 99, with the remaining end of the cable being attached to the cantilever arm. The pulley is anchored to the upper marginal end of the movable member. This action raises the chair twice the length of the stroke and therefore enables the camway to be reduced in effective length.

I claim:

1. Lift apparatus by which wheelchair invalids are lifted from one location, through a spiral of several degrees, and to a second location, comprising:

a stationary vertical support member, a movable vertical support member, said stationary member being telescopingly received within said movable member to form a concentrically arranged coacting piston and a cylinder; means by which one of said members is received in sealed relationship within the other to provide a variable chamber which effects reciprocatory motion therebetween when fluid is forced to flow into and out of said variable chamber;

cam means jointly connected to said stationary and movable members for causing relative axial rotation therebetween when said members are reciprocated;

said cam means includes two parallel, radially spaced slots cut longitudinally through the wall of said movable member, with the slots each commencing at a medial part of the movable member and extending down toward one marginal end thereof where the slots converge together to form a camway in the form of a continuous slot, thereby leaving an elongated tab between the slots, said tab having a free end and a connected end;

a bridge connected to said free end of said tab and two radially spaced locations on the lower marginal end of said movable member to thereby rigidify the free end of the tab; a switch means pivotally affixed to the connection effected at said tab, a cam follower connected to said fixed member and received within said camway;

said switch means being positioned to engage said cam follower and force the follower to be changed from one to the other of said two spaced slots when one support member reciprocates within the other;

a cantilever arm having opposed ends, one end being in the form of a boss which is slidably received about said movable member, lock means by which said cantilever arm is secured to said movable member;

chair engaging assemblies connected to said cantilever arm for releasably engaging a chair; and, a control valve means flow connected to said variable chamber, and adapted to be connected to a source of pressure and to a discharge, so that said control valve means can be actuated to connect the source of pressure or the discharge to the variable chamber, thereby reciprocating the fixed and movable members respective to one another.

2. The lift apparatus of claim 1 wherein said two parallel, radially spaced slots are spaced apart substantially 90° from one another to thereby cause said cantilever arm to be pivoted through substantially 90° when said movable member is extended and thereafter retracted.

3. The lift apparatus of claim 1 wherein said chair arm engaging assemblies include two spaced, vertical members rotatably received by a marginal free end of said cantilever arm, the marginal free end of said vertical members being turned horizontally into a lateral member which is positioned normally respective to said cantilever arm and parallel respective to one another;

a chair means having a seat, arms, and a back, means on said chair arm for releasably engaging said lateral members so that said lift apparatus can releasably engage the arms of said chair means and lift the chair means.

4. The lift apparatus of claim 3 wherein said chair arm is in the form of a reinforced curved member which downwardly opens and receives said lateral member therein; the back of said chair means is a reinforced, downwardly opening member which receives a marginal length of the cantilever arm therewithin so that said seat is supported by said back and said arms.

5. The lift apparatus of claim wherein said two parallel, radially spaced slots are spaced apart about 90° from one another to thereby cause said cantilever arm to be pivoted through about 90° when said movable member is extended and thereafter retracted;

said chair arm engaging assemblies include two spaced, vertical members rotatably received by a marginal free end of said cantilever arm, the marginal free end of said vertical members being turned horizontally into a lateral member which is positioned normally respective to said cantilever arm and parallel respective to one another;

a chair means having a seat, arms, and a back, means on said chair arm for releasably engaging said lateral members so that lift apparatus can releasably engage the arms of said chair means and lift the chair means.

6. Lift apparatus by which wheelchair invalids are spirally lifted from one location to another, comprising:

a stationary support member, a movable support member; said stationary support member being telescopingly received within said movable member to form a concentrically arranged coacting piston and a cylinder; means by which one of said members is received in sealed relationship within the other to provide a variable chamber which effects a reciprocatory motion when fluid is forced to flow into or out of said chamber;

means including a valve by which a flow of fluid is conducted into and out of said variable chamber to cause said movable and fixed members to reciprocate respective to one another;

cam means jointly connected to said stationary and movable members for causing relative axial rotation between said stationary and movable members when said members are reciprocated relative to one another;

said cam means includes two radially spaced slots cut into a marginal length of said movable member, said slot includes a first leg which commences at a medial portion of said movable member and extends toward the lower end thereof where said slot bends for 180° to form a second leg which extends back up said medial portion of said movable member in parallel relationship to the first leg, thereby forming a tab between said legs, said tab having a free and a fixed end; a bridge including a fastener means by which said free end of said tab is rigidly affixed to opposed sides of said movable member;

a switch means having a cam guide means formed thereon, said switch means being pivotally affixed to said bridge such that said cam follower is forced to alternately enter said first and second leg each reciprocation of said movable member;

a cantilever arm having an end adjustably affixed to said movable member and a free end radiating from said movable member;

a chair lift assembly formed on a marginal free end of said cantilever arm, comprising spaced chair engaging members by which the arms of a chair can be removably engaged and supported;

so that an invalid can be seated in a chair and the arms of the chair can be removably attached to said spaced chair engaging members thereof enabling the invalid together with his chair to be lifted in a spiral manner from one location to another, when the valve is actuated to cause flow to occur into and out of said expansible chamber.

7. The lift apparatus of claim 6 wherein said two parallel radially spaced slots are spaced about 90° from one another to thereby cause said cantilever arm to be pivoted through about 90° when said movable member is extended and thereafter retracted.

8. The lift apparatus of claim 6 wherein said chair engaging assemblies include two spaced vertical members rotatably received by a marginal free end of said cantilever arm, the marginal free end of said vertical members being turned horizontally into a lateral member which is positioned normally respective to said cantilever arm and parallel respective to one another;

a chair means having a seat, arms, and a back, means on said chair arm for releasably engaging said lateral members so that lift apparatus can releasably engage the arms of said chair means and lift the chair means.

9. The lift apparatus of claim 8 wherein said chair arm is in the form of a reinforced curved member which downwardly opens and receives said lateral member therein; said back of said chair means is a reinforced downwardly opening member which receives a marginal length of the cantilever arm therewithin so that said seat is supported by said back and said arms.

10. The lift apparatus of claim 6 wherein said two parallel radially spaced slots are spaced apart from one another to thereby cause said cantilever arm to be pivoted when said movable member is extended and thereafter retracted;

said chair arm engaging assemblies include two spaced vertical members rotatably received by a marginal free end of said cantilever arm, the marginal free end of said vertical members being turned horizontally into a lateral member which is positioned normally respective to said cantilever arm and parallel respective to one another;

a chair means having a seat, arms, and a back, means on said chair arm for releasably engaging said lateral members so that lift apparatus can releasably engage the arms of said chair means and lift the chair means.

11. The lift apparatus of claim 6 wherein said two parallel radially spaced slots are spaced apart about 90° from one another to thereby cause said cantilever arm to be pivoted through about 90° when said movable member is extended and thereafter retracted;

said chair arm engaging assemblies include two spaced vertical members rotatably received by a marginal free end of said cantilever arm, the marginal free end of said vertical members being turned horizontally into a lateral member which is positioned normally respective to said cantilever arm and parallel respective to one another;

a chair means having a seat, arms, and a back, means on said chair arm for releasably engaging said lateral members so that lift apparatus can releasably engage the arms of said chair means and lift the chair means;

said chair arm is in the form of a reinforced curved member which downwardly opens and receives said lateral member therein; said back of said chair means is a reinforced downwardly opening member which receives a marginal length of the cantilever arm therewithin so that said seat is supported by said back and said arms.

12. The lift apparatus of claim 6 and further including a pressure measuring apparatus for measuring the pressure effected within said variable chamber;

means connecting said pressure measuring apparatus to said variable chamber, means forming indicia on said measuring apparatus related to the weight of a person lifted by said chair engaging members.

13. The lift apparatus of claim 1 and further including a pressure measuring apparatus, means connecting said pressure measuring apparatus to said variable chamber so that the weight of a person lifted by said chair engaging members can be determined.

14. The lift apparatus of claim 13 wherein said pressure measuring apparatus includes means forming indicia thereon related to a numerical value of a persons weight so that a person seated in the chair and lifted by said chair engaging assemblies can be weighed.

* * * * *

UNITED STATES PATENT OFFICE
CERTIFICATE OF CORRECTION

PATENT NO. : 4,075,719
DATED : February 28, 1978
INVENTOR(S) : Lawrence J. Sullivan It is certified that error appears in the above-identified patent and that said Letters Patent are hereby corrected as shown below:

Column 4, line 9, correct spelling of "Hence".

Column 5, line 2, substitute --lift-- for "left".

Column 5, line 42, substitute --the-- for "with".

Column 7, line 60, substitute --claim 1-- for "claim".

Column 8, line 32, substitute --towards-- for "toward".

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*